United States Patent [19]

Ohta et al.

[11] Patent Number: 4,960,051

[45] Date of Patent: Oct. 2, 1990

[54] INK FEEDER DRIVER FOR ROTARY PRESS

[75] Inventors: Hideo Ohta, Tokyo; Haruyoshi Kobayashi, Yokohama, both of Japan

[73] Assignee: Kabushiki Kaisha Tokyo Kikai Seisakusho, Tokyo, Japan

[21] Appl. No.: 366,209

[22] Filed: Jun. 12, 1989

Related U.S. Application Data

[63] Continuation of Ser. No. 190,850, May 6, 1988, abandoned.

[30] Foreign Application Priority Data

May 7, 1987 [JP] Japan ..... 62-109852

[51] Int. Cl.[5] ..... B41F 31/10; B41L 27/00

[52] U.S. Cl. ..... 101/349

[58] Field of Search ..... 101/350, 351, 352, 148, 101/207–210, 349, 216, 219

[56] References Cited

U.S. PATENT DOCUMENTS 2,351,013 6/1944 Carpenter, Jr. ..... 101/219

2,447,872 8/1948 Riggs et al. ..... 101/349

FOREIGN PATENT DOCUMENTS 58-18732 4/1983 Japan .

*Primary Examiner*—J. Reed Fisher

*Attorney, Agent, or Firm*—Armstrong, Nikaido, Marmelstein, Kubovcik & Murray

[57] ABSTRACT

An ink feeder driver for a rotary press in which switching of ink feeder drive paths can be effected by merely effecting a selection as to whether first and second gears are to be coupled together via only a second idle gear of via both first and second idle gears in mesh with each other, to match the direction of rotation of a first gear which is required to be rotated in a fixed direction at all times and the direction of rotation of a second gear rotated in a direction matched to the direction of rotation of a printing cylinder. The direction of rotation of the first gear with respect to the second gear is reversed by displacing the second idle gear by operating a displacing means.

7 Claims, 5 Drawing Sheets

INK FEEDER DRIVER FOR ROTARY PRESS

This application is a continuation of application Ser. No. 190,850, filed May 6, 1988, now abandoned.

BACKGROUND OF THE INVENTION

1. Field of the Invention

This invention relates to an ink feeder driver for a rotary press.

2. Description of the Prior Art

Japanese Utility Model Application Laid-Open Publication, No Sho 58-18732 (1983-18732) discloses a pertinent ink feeder driver,in which a drive path when a printing cylinder is rotated counterclockwise and another drive path when the printing cylinder is rotated counterclockwise are provided. In this system, in accordance with the direction of rotation of the printing cylinder an idle gear provided in either one of the two drive paths is displaced in its axial direction to disengage the gear and thus disconnect this drive path.

More specifically, when the printing cylinder is to be rotated clockwise, the idle gear provided in one of the drive path is displaced to disengage the gear from the gear train, while the idle gear in the other drive path is meshed with the gear train. When the printing cylinder is rotated counterclockwise, on the other hand, the idle gear in the one drive path as noted above is returned into mesh with the gear train, while the idle gear in the other drive path is disengaged from the gear train.

The displacement of the idle gear is attained by manually operating a gear train shifting mechanism as shown in FIGS. 3 and 4 of the publication noted above.

The prior art ink feeder driver as described above requires labor and time for switching it in compliance with a change in the direction of rotation of the printing cylinder, as a result of which its operational efficiency is inferior.

SUMMARY OF THE INVENTION

The present invention has been developed in the light of the above circumstances, and it has an object of providing an ink feeder driver for a rotary press, in which the switching of ink feeder drive paths for compliance with a change in the direction of rotation of the printing cylinder can be effected by merely moving a displacing means for one idle gear, so that the switching can be attained in a very short period of time and entirely manually.

To attain the above object, according to a first aspect of the invention, there is provided an ink feeder driver for a rotary press, which comprises a first idle gear in mesh at all times with one of two gears, i.e., first and second gears, the first gear rotating in a direction matched to the direction of rotation of an ink cylinder required to be rotated only in a predetermined direction, the second gear being disposed at a position not in mesh with the first gear, capable of being rotated forwards and backwards and rotating in a direction matched to the direction of rotation of a printing cylinder, a second idle gear in mesh at all time with the outer one of the two gears which is not in mesh with the first idle gear, and displacing means for displacing the second idle gear between a position, at which the second idle gear is in mesh with the one gear noted above and in mesh with the first idle gear, and a position, at which the second idle gear is in mesh with the idle gear and not in mesh with the one gear noted above.

In this first aspect of the invention, the switching of drive paths can be effected by merely effecting a selection as to whether the first and second gears are coupled together via the second idle gear alone or via the first and second idle gears in mesh with each other to match the directions of rotation of the first gear which is required to be rotated in a fixed direction at all time and the second gear rotated in a direction matched to the direction of rotation of the printing cylinder by displacing the second idle gear by operating the displacing means.

In a second aspect of the invention, displacement detection means is further provided in the ink feeder driver in the first aspect to provide an ink feeder driver for a rotary press, in which the start of the printing cylinder is inhibited when the displacement caused by the displacing means and switching of the direction of rotation of the printing cylinder are not matched.

In a third aspect of the invention, switching signal generation means is still further provided in the ink feeder driver in the first aspect to provide an ink feeder driver for a rotary press, in which a switching operation signal is transmitted to displacing means in response to the detection of switching of the direction of rotation of the printing cylinder to permit the displacement by the displacing means to be effected automatically through switching of the direction of rotation of the printing cylinder.

The above and many other advantages, features and additional objects of the present invention will become manifest to those versed in the art upon making reference to the following detailed description and accompanying drawings in which preferred structural embodiments incorporating the principles of the present invention are shown by way of illustrative examples.

DETAILED DESCRIPTION OF THE PREFERRED EMBODIMENTS

Figure 1:
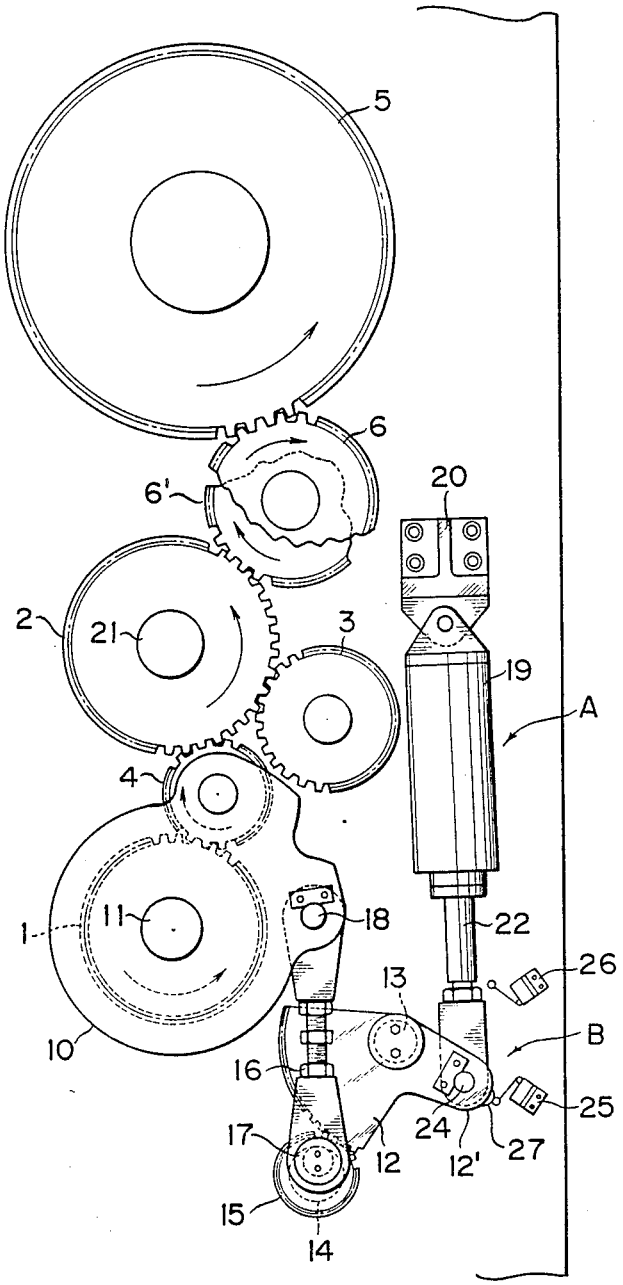
FIGS. 1 and 2 are schematic views illustrating the construction and operation of an embodiment of the invention.

Now, some preferred embodiments of the invention will be described with reference to FIGS. 1 to 6.

A rotary press is driven from a drive power source (not shown) via a main drive path (not shown).

An ink feeder driver path usually consists of a train of a plurality of gears in mesh with one another, the input side end gear in the gear train being a printing cylinder gear 5 secured to a shaft of a printing cylinder driven by the main drive path.

An ink cylinder which is continuously rotated in one direction at all times is provided in an input side section of an ink feed path (not shown). A first gear 1 is secured to a shaft 11 of the ink cylinder. A second gear 2 which is in mesh with neither the printing cylinder gear 5 nor the first gear 1 is disposed between the gears 5 and 1. Idle gears 6 and 6' having a common axis and rotating in unison with each other are disposed between the printing cylinder gear 5 and second gear 2.

An arm member 10 is mounted for swinging on the shaft 11. A second idle gear 4 is rotatably mounted on the arm member 10 and in mesh at all time with the first gear 1. A first idle gear 3 is disposed between the second and first gears 2 and 1 and in mesh at all time with the second gear 2.

As another possible embodiment (not shown) the axis of swinging of the arm member 10 is coincident with the axis of a shaft 21 of the second gear 2, the first idle gear 3 is in mesh at all time with the first gear 1 while the second idle gear 4 is in mesh at all time with the second gear 2.

A sector segment gear 12 is rotatably mounted on a shaft 13. A cam gear 15 which is secured to an eccentric cam 14 is in mesh with the sector segment gear 12. A rod member 16 is rotatably coupled at one end to an eccentric shaft 17 of the eccentric cam 14 and also rotatably coupled at the other end by a pin 18 to one side of the arm member 10.

In FIG. 1, reference numeral 19 designates a drive cylinder having a stem pivoted to a stationary bracket 20. The drive cylinder 19 has a piston rod 22 coupled by a pin 24 to one side 12' of the sector segment gear 12.

The drive cylinder 19, sector segment gear 12, cam gear 15, eccentric cam 14, rod member 16 and arm member 10 constitute displacing means A for displacing the second idle gear 4.

Switches 25 and 26 are provided on a frame via a bracket. A dog 27 is provided on one side 12' noted above of the sector segment gear 12. These components constitute detection means B for detecting the displacement position of the displacing means A.

Figure 3:
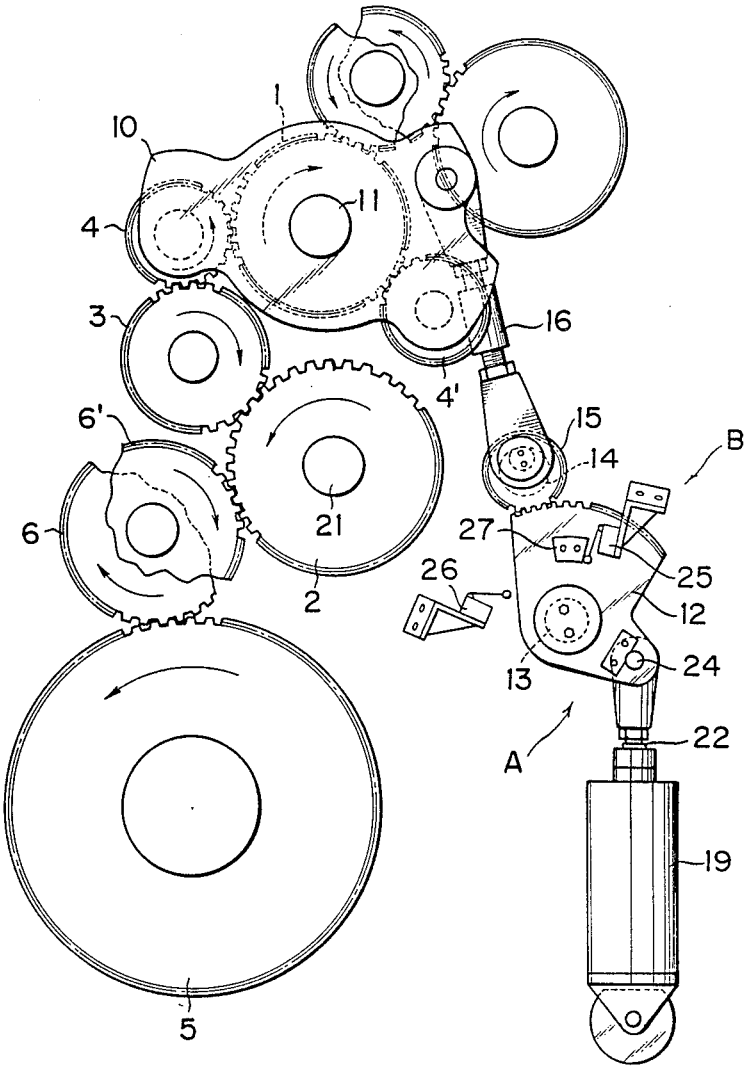
FIGS. 3 and 4 are schematic views illustrating the construction and operation of a different embodiment of the invention.
Figure 4:
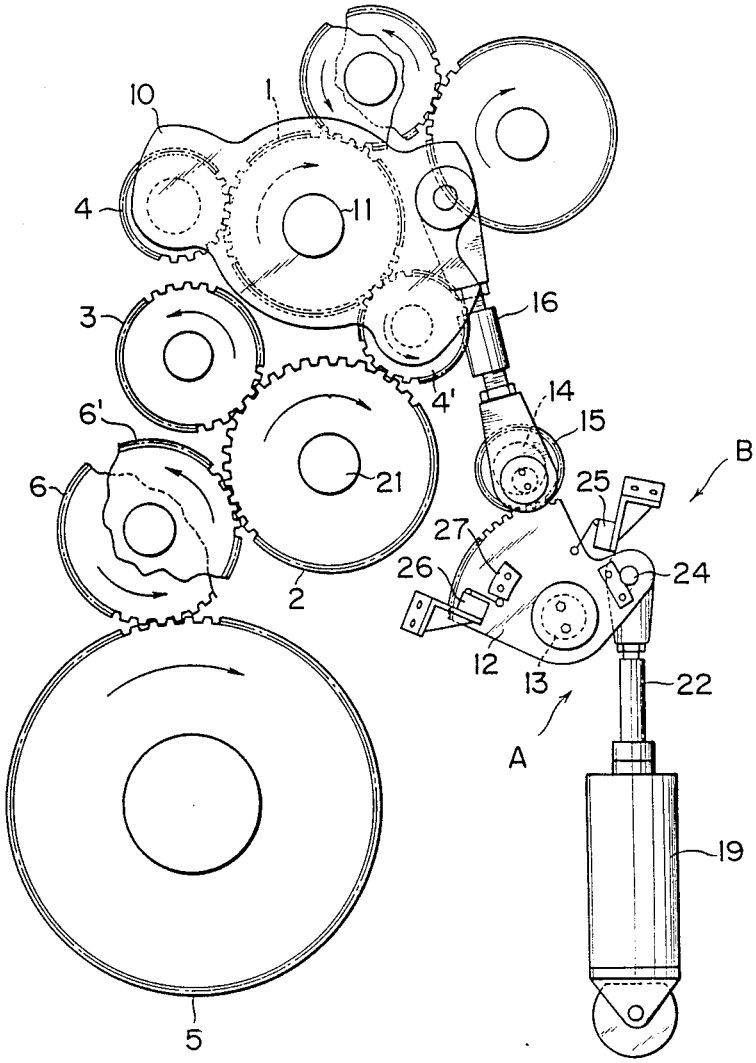

FIGS. 3 and 4 show a different embodiment of the ink feeder driver according to the invention.

This embodiment is different from the preceding embodiment in that two second idle gears 4 and 4' on arm member 10. In this instance, with elongation or contraction of the piston rod 22 of the drive cylinder 19 the second idle gears 4 and 4' are displaced to change the gear path arrangement of the ink feeder driver such as to match the direction of rotation of the printing cylinder 5 and the direction of rotation of the first gear. The other elements are designated by reference numerals like those in the previous embodiment and are not described to avoid duplication of the description.

Figure 5:
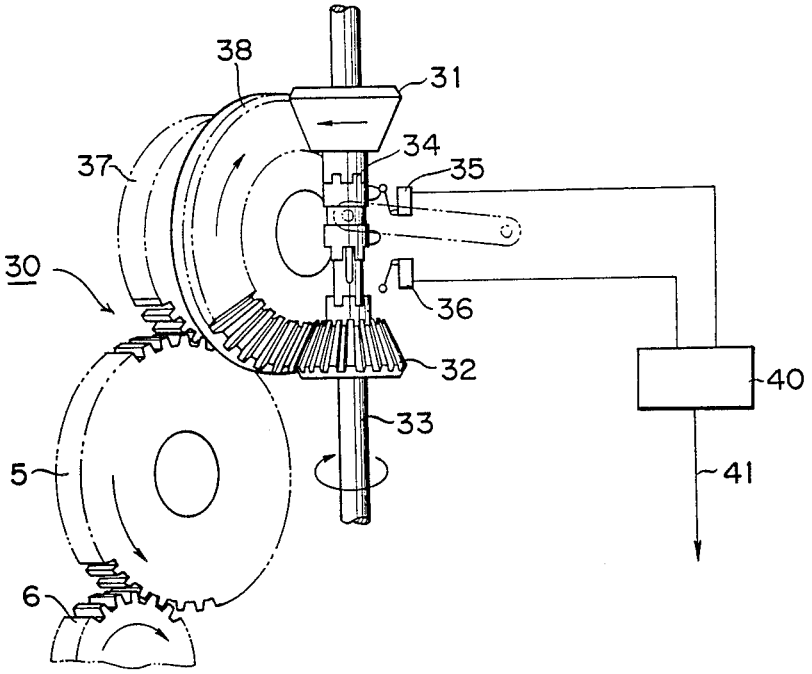
FIG. 5 is a schematic perspective view showing a printing cylinder rotation direction switching section and rotation direction switching detection means.
Figure 6:
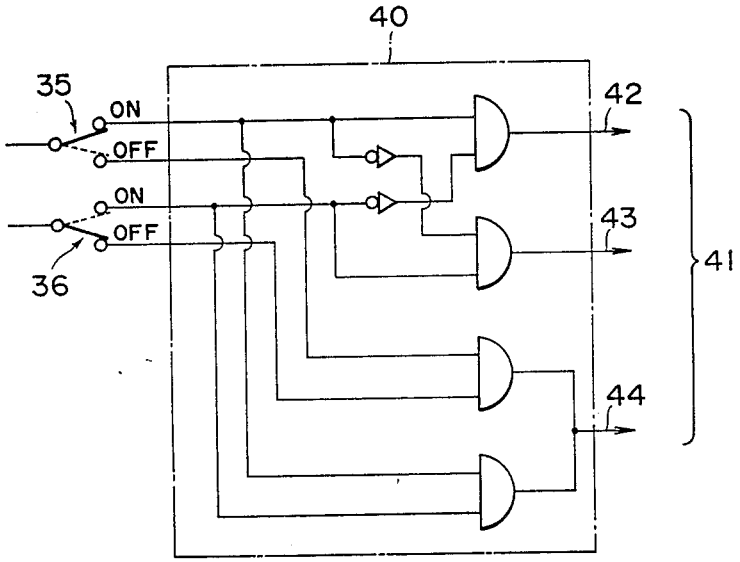
FIG. 6 is a circuit diagram showing a logic circuit structure of a printing cylinder rotation direction switching signal generation means.

The main drive path is provided with a printing cylinder rotation direction switching section 30 as shown in FIG. 5 and a printing cylinder rotation direction switching signal generation means 40 as shown in FIGS. 5 and 6.

The printing cylinder rotation direction switching section 30 includes first and second vertical gears 31 and 32 rotatably provided via bearings on a vertical shaft 33 in the main drive path, a clutch mechanism 34 for selectively coupling either one of the two vertical gears 31 and 32 to the vertical shaft 33 and an intermediate gear 38 in mesh with the first and second gears 31 and 32 and rotating in unison with a printing cylinder drive gear 37 in mesh with the printing cylinder gear 5.

The vertical shaft 33 is rotated by a prime drive (not shown) only in one direction at all time. The clutch mechanism 34 may thus be switched such that the printing cylinder gear 5 is rotated only in the clockwise (or forwards) or only counterclockwise (or backwards) via either first or second vertical gear 31 or 32, intermediate gear 38 and printing cylinder drive gear 37 rotated in unison with the intermediate gear 38. The rotation direction switching section 30 includes rotation direction detection means, e.g., limit switches 35 and 36 for detecting the coupling side of the clutch. According to on/off signals of the limit switches 35 and 36, the switching signal generation means 40 generates a switching signal 41 for the displacing means A.

Figure 2:
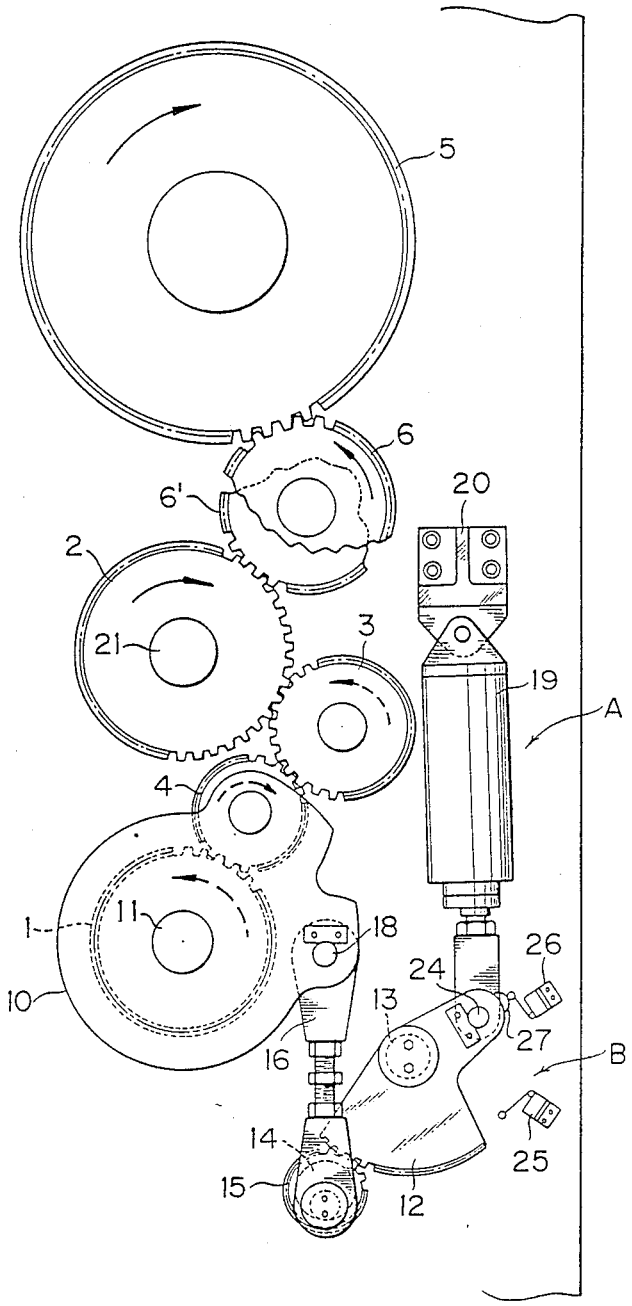

In the example shown in FIGS. 5 and 6, the clutch mechanism 34 causes the first vertical gear 31 to be rotated with the rotation of the shaft 33, thus causing counterclockwise (or forward) rotation of the printing cylinder 5. At this time, an "on" signal of the limit switch 35 or "off" signal of the limit switch 36 causes the switching signal generation means 40 generates a forward rotation displacement signal 42 to cause the displacing means A to effect displacement to obtain a state matched to the counterclockwise rotation (or forward rotation) of the printing cylinder gear 5 as shown in FIG. 1 and 3. When the clutch mechanism 34 is switched to the state converse to the state shown in FIG. 5, the second vertical gear 32 is rotated with the rotation of the vertical shaft 33 to cause clockwise (or backward) rotation of the printing cylinder gear 5. At this time, the "off" signal of the limit switch 35 or "on" signal of the limit switch 36 causes the switching signal generation means 40 to generate a backward rotation displacement signal 43 to cause the displacing means A to effect displacement to obtain a state matched to the clockwise (or backward) rotation of the printing cylinder gear 5 as shown in FIG. 2 or 4. In FIG. 6, the state of limit switches 35 and 36 is shown by broken lines.

When the limit switches 35 and 36 both provide the "on" or "off" signal due to some trouble, the switching signal generation means 40 generates an abnormal switching signal 44 so as to let some alarm to be produced and shown to the operator. Simultaneously or concurrently, the means 40 locks the main path (not shown).

Now, the operation of the driver feeder driver according to the invention will be described hereinafter.

In response to a requirement of printing or due to other reasons, gears are provided in the main drive path (not shown) to cause rotation of the printing cylinder (not shown) of the rotary press in the clockwise or counterclockwise direction.

While the direction of rotation of the printing cylinder can be changed, an input side ink cylinder (not shown) on an ink feed path (not shown) of the ink feeder has to be rotated in a fixed direction at all times although it is driven via the printing cylinder gear 5 secured to the shaft of the printing cylinder. Therefore, it is necessary to match the directions of rotation of the printing cylinder and ink cylinder. To this end, the displacing means A changes the ink feeder driver gear train between the printing cylinder gear 5 secured to the printing cylinder shaft and the first gear 1 secured to the ink cylinder shaft 11.

When the printing cylinder is to be rotated in the counterclockwise direction, the piston rod 22 of the drive cylinder 19 is elongated or advanced to cause clockwise rotation of the sector segment gear 12. The rotation of the sector segment gear 12 causes rotation of the eccentricity cam 14 via the cam gear 15 in mesh with the sector segment, gear 12. While the rotation of the eccentricity cam 14 causes a movement of the rod member 6 in the axial direction thereof, when the piston rod 22 of the drive cylinder 19, the rod member 16 is pushed up along its axis as shown in FIG. 1. The movement of the rod member 16 causes counterclockwise rotation of the arm member 10, causing the second idle gear 4 to be meshed with the first and second gears 1 and 2 at the same time and also disengaged from the first idle gear 3 (see FIG. 1).

Further, as the sector segment gear 12 is rotated clockwise, it acts on the switch 25. When an AND condition consisting of the action on the switch 25 as noted above and that the detection means 35 or 36 is detecting that the main drive path has been switched to a state for rotating the printing cylinder counterclockwise is satisfied, the operation of the drive power source of the rotary press is allowed.

When the printing cylinder is to be rotated in the clockwise direction, the piston rod 22 of the drive cylinder 19 is contracted or retreated to cause counterclockwise rotation of the sector segment gear 12. The rotation of the sector segment gear 12 causes rotation of the eccentric cam 14 via the cam gear 15 in mesh with the sector segment gear 12, causing the rod member 16 to be pulled down along the axis. The movement of the rod member 16 causes clockwise rotation of the arm member 10 to cause the second idle gear 4 to be meshed with the first gear 1 and first idle gear 3 at the same time and disengaged from the second gear 2 (see FIG. 2).

Further, as the sector segment gear 12 is rotated counterclockwise, it acts on the switch 26. When an AND condition consisting of the action on the switch 26 noted above and that the detection means 36 or 35 is detecting that the main drive path has been switched to a state for rotating the printing cylinder clockwise is satisfied, the operation of the drive power source of the rotary press is allowed.

As has been described above, in the embodiment shown in FIG. 1, the first gear 1 secured to the shaft 11 of the ink cylinder can be rotated counterclockwise at all times irrespective of whether the direction of, rotation of the printing cylinder gear 5 is counterclockwise or clockwise as shown by the arrow.

Further, in either of the embodiments shown in FIGS. 1 and 3, if a circuit is constructed such as to operate the drive cylinder 19 according to a switching signal for switching the detection means 35 or 36 provided in the main drive, path or switching signal generation means 40 interlocked to the detection means, by merely switching the direction of rotation of the printing cylinder the gear train in the ink feeder drive can be changed to match the directions of rotation of the printing cylinder gear 5 and first gear 1. Again in this case, the switches 25 and 26 are effective for confirming that the gear train is right.

The embodiments described above are by no means limitative, and various changes and modifications in the design are possible without departing from the scope as claimed in the claims.

What is claimed is:

1. An ink feeder driver for a rotary press having a printing cylinder (5) rotatable in either of two directions and an ink cylinder required to be rotated only in a predetermined direction, means for driving said pringing cylinder in either of two rotational directions, means for drivingly connecting said printing cylinder with said ink cylinder and for rotating said ink cylinder in a predetermined single rotational direction irrespective of the direction of rotation of said printing cylinder comprising:

a first gear (1) connected to said ink cylinder and rotating about an axis (11) in a direction matched to the direction of rotation of said ink cylinder;

a second gear (2) rotating about an axis (21) fixedly disposed with respect to said first gear and connected to said printing cylinder (5) to rotate in the same direction thereof;

a first idle gear (3) fixedly positioned and at all times meshed with said second gear (2);

a second at least one idle gear (4,4') meshed at all times with said first gear (1) and engagable with one of said second gear (2) and said first idle gear (3);

a displacing means (10) rotatable about an axis (11 or 21) and carrying said second at least one idle gear (4,4') rotationally thereon; and means (19) for rotating said displacing means (10) about its axis (11 or 21) so as to selectively move said second at least one idle gear (4,4') between a first position wherein it is in mesh with said second gear (2) and a second position wherein it is in mesh with said first idle gear (3).

2. An ink feeder driver as recited in claim 1, wherein said second at least one idle gear comprises a single idle gear (4) that meshes with said second gear (2) in said first position and meshes with first idle gear (3) in said second position.

3. An ink feeder driver as recited in claim 1, wherein said second at least one idle gear comprises one gear (4') that meshes with said second gear (2) in said first position, and another gear (4) that meshes with said first idle gear (3) in said second position.

4. An ink feeder driver as recited in claim 1 further including displacement detection means for detecting the position of said displacement means in said first and second positions and for inhibiting rotation of said printing cylinder when said displacement means is not positioned to drive said ink cylinder to rotate in said predetermined direction.

5. An ink feeder driver as recited in claim 1 further including signal generator means connected to a driving means for said printing cylinder to provide a signal determined by the direction of rotation of said driving means, and means responsive to said signal for switching said displacing means between said first position and said second position to drive said ink cylinder to rotate in said predetermined direction.

6. An ink feeder driver as recited in claim 3 further including displacement detection means for detecting the position of said displacement means in said first and second positions and for inhibiting rotation of said printing cylinder when said displacement means is not positioned to drive said ink cylinder to rotate in said predetermined direction.

7. An ink feeder driver as recited in claim 3 further including signal generator means connected to a driving means for said printing cylinder to provide a signal determined by the direction of rotation of said driving means, and means responsive to said signal for switching said displacing means between said first position and said second position to drive said ink cylinder to rotate in said predetermined direction.

* * * * *